United States Patent [19]

Greenhut

[11] Patent Number: 4,620,703

[45] Date of Patent: Nov. 4, 1986

[54] EXERCISE APPARATUS

[76] Inventor: Paul M. Greenhut, 4581 Sequoia Dr., Harrisburg, Pa. 17109

[21] Appl. No.: 660,526

[22] Filed: Oct. 12, 1984

[51] Int. Cl.[4] ..... A63B 21/24

[52] U.S. Cl. ..... 272/129; 272/131

[58] Field of Search ..... 272/129, 131, 132, 125, 272/117, 118, 73, 130, DIG. 4, 116, 93, 134; 128/25 R

[56] References Cited

U.S. PATENT DOCUMENTS

| | | | |
|---|---|---|---|
| 3,366,903 | 1/1968 | Searle et al. | 335/209 |
| 3,572,700 | 3/1971 | Mastropaolo | 272/132 X |
| 3,869,121 | 3/1975 | Flavell | 272/129 |
| 4,084,810 | 4/1978 | Forsman | 272/129 X |
| 4,282,865 | 8/1981 | Pogue | 128/25 R |
| 4,322,071 | 3/1982 | Lambert, Jr. et al. | 272/118 |
| 4,337,050 | 6/1982 | Engalitcheff, Jr. | 272/129 X |
| 4,349,192 | 9/1982 | Lambert, Jr. et al. | 272/118 |
| 4,373,717 | 2/1983 | Lambert, Jr. | 272/118 X |

FOREIGN PATENT DOCUMENTS

| | | | |
|---|---|---|---|
| 3205581 | 8/1983 | Fed. Rep. of Germany | 272/117 |

*Primary Examiner*—Richard J. Apley

*Assistant Examiner*—Robert W. Bahr

*Attorney, Agent, or Firm*—Ostrolenk, Faber, Gerb & Soffen

[57] ABSTRACT

An exercise apparatus features a mechanical arrangement in which the motion of a rotary passive resistance device is translated to bi-directional linear motion. The apparatus has a central columnar structure on which a traveler assembly is carried for movement in a generally vertical plane. The traveler assembly has a horizontal bar, mounted between arms, through which the one exercising applies effort to the apparatus. A counterweight is provided to balance the weight of the traveler assembly. First and second cables extend respectively up and down from the traveler assembly, across idler pulleys, and then respectively down and up to a common rotatably mounted drum assembly. Thus, movement of the traveler assembly results in winding of one cable onto the drum assembly, while the other is unwound. A rotary passive resistance device, preferably a magnetic particle brake, is connected to the drum to provide a controllable force which the user must overcome. An electrical control system makes possible selection of different resistances for upward and downward motion.

8 Claims, 8 Drawing Figures

EXERCISE APPARATUS

BACKGROUND OF THE INVENTION

It has long been recognized that exercise with weights can be highly beneficial for most people. Historically, the principal obstacle to its practice has been the problem of keeping the weights under control while they are being lifted. The danger involved with placing oneself beneath a heavy weight, with only one's own strength and skill to prevent the weight from falling, is daunting even for experienced weightlifters. Professionals in the field continually caution that heavy weights should not be lifted unless others are standing by to help in an emergency. Even when weights do not fall, the threat of their doing so can cause injury. Unnatural movements, made to keep a weight from going out of control, can easily cause strains in the already heavily loaded muscles. Many injuries to muscles of the back have occurred in this way. Even in the absence of injury, the value of weightlifting is always compromised by the need to make one's first concern the control of the elevated weights, leaving the exercise of particular muscles to whatever capabilities remain.

Over the years, recognition of these deficiencies has inspired the creation of a variety of devices intended to make this kind of exercise safer and more effective. These have generally fallen into two broad categories: weight guidance systems and weight substitution systems.

Weight guidance systems usually only allow vertical movement. In modern designs, the weights are usually separated from the means upon which the one exercising exerts effort. The connection between the two is most often made by cable and pulley arrangements, though some relatively inexpensive ones currently available use a rigid mechanical connection. The weights move vertically in a guideway. A central structure, which in the better systems is usually quite bulky, supports the various components.

In almost all of the apparatus of this type currently available, the primary motion available to the one exercising is in a vertical plane, in the upward direction. The downward return to the starting position is accomplished by the impetus of the weights themselves. Some designs may be converted to a downward vertical movement, with an upwards return. The ease with which this can be done is usually in direct proportion to the cost.

Weight guidance systems are beneficial, but they represent only a partial solution to the problem of control. Limiting degrees of freedom reduces the number of potential causes of accidents, but the degree of freedom which must remain, the vertical, has by far the greatest potential for harm. In all of these systems, it is still possible for the actuation means to be driven back into the user, impelled by the weights to which it is attached. This danger of "backlash" has caused designers in the field to make undesirable compromises to assure a reasonable degree of safety. The most common of these is a severe limitation on the travel of the operating means, combined with a particular shaping of the means itself. Typically, the operating means is located relatively high on the central structure, with its travel restricted mechanically to about two (2) feet. This tends to assure that in the case of a backlash, the user is unlikely to be trapped beneath the operating means. The design of the operating means itself is usually complementary in this purpose. Instead of being configured as a horizontal bar, the most ergometrically desirable shape to give something which must be pushed or pulled vertically, these known means usually have the shape of handlebars. The virtue of this is that in a backlash situation, the two handles are likely to pass around the user. Its principal disadvantage is an operational one. Handlebars require that the user's hands be placed in prescribed locations, regardless of how awkward or uncomfortable it may be for a particular individual. The combination of this and restricted movements limits the usefulness of most of these devices.

Attempts to overcome problems such as these have brought about the existing family of weight substitution apparatus. These deal with the problem of backlash by eliminating the weights which cause it. The ones currently available use dynamic reactions to create the forces which the user must overcome. The most common approach is to have a hydraulic or air cylinder connected to an operating means, which moves the piston inside. Movement of the piston forces the fluid in the cylinder through an orifice. The pressure necessary to do this is translated into a force on the piston, which is then seen as a resistance to movement of the operating means. These devices are basically "passive" in that their operating means move only in response to an urge from the user. They can still produce a backlash due to residual pressure, but the extent and severity of this is usually minimal. Because of this, they commonly have operating means featuring true horizontal bars. Their principal disadvantages are a difficulty in making precise adjustments of resistance, and a pronounced sensitivity to speed of movement. It is a basic characteristic of the principles by which these machines operate that resistance to movement increases drastically with the speed of the movement. Through rigorous design, these problems can be minimized but the solutions are difficult and expensive to implement.

This category also contains a type of apparatus known as a clutch/flywheel device. In this, the operating means moves a cable, which turns a drum to which is attached a clutch and flywheel assembly. Resistance is attained through acceleration of the mass of the flywheel. The clutch engages the flywheel only when the operating means is moved. This type of device is also sensitive to speed of movement. This concept is inherently free of backlash.

Most of the existing devices in the "weight substitute" category are mechanically quite simple, with the result that their inherent idiosyncracies of performance remain intact. Because of this, their use is usually restricted to instances in which safety is of the greatest importance.

For a great many years, inventors have considered the idea of using electro-magnetically developed resistance as the basis of an exercise machine. See, for example, Gardiner, U.S. Pat. No. 444,881, dated 1891, and Raymond, U.S. Pat. No. 670,006, dated 1901. Each consisted of a small generator which was turned by two cables which were to be pulled by the user's hands. In both of these devices, the current so generated was to be transmitted through the cables to the body of the user. It seems that at that time, it was widely believed that passing a small amount of current through the body was beneficial. Fortunately, neither of these would have been capable of producing much power.

The generator based system is also shown in Cooper, U.S. Pat. No. 857,447, dated 1907, which described a "rowing machine". The operating means was a hand held bar having cords attached to the respective ends. The other ends of the cords were wound around a shaft, which was connected to a generator. When the cords were pulled, the generator turned. Rewind was by automatic reversal of the generator into a motor. This was clearly an attempt at a "passive" system, although it seems to have been a largely unsuccessful one. Its control arrangement was not capable of effectively varying its resistance, and weights had to be included for that purpose.

The problem of control is common to all generator based resistance systems. Under constant excitement, the torque requirements of generators vary drastically with speed of rotation. The relationship is direct, but nonlinear, and difficult to control precisely over a wide range of speeds, without recourse to electronic power supplies run by computers. Even with this, it is effectively impossible to maintain normal running torque resistances into the low speed range. This characteristic inevitably leads to difficulties in exercise apparatus, in which low speeds are a normal part of the operational regime.

Attempts have been made to overcome these problems, but success has been limited. In 1975, Flavell, in U.S. Pat. No. 3,869,121, described a generator based apparatus which featured a sophisticated electronic control system to maintain a constant level of resistance. Even this would have been ineffective at low speeds, so a speed increasing means was used to minimize the time spent in this operating region as well as to reduce the size of the generator required.

Limitations similar to those of generators also apply to eddy current brakes. From some points of view, these can be seen as crude generators which dissipate their electrical output internally. Their torque resistance also varies nonlinearly with speed of rotation, and can be controlled in the same ways. They are less expensive than generators of comparable torque resistance, and energy absorbing capability, but require more excitement current, so what is saved in the cost of machinery is lost again in the cost of its power supply. The search prior to this application disclosed one such device, patented in the Soviet Union (SU No. 0869781) in 1981.

The concept of a brake as the source of resistance of an exercise device is an attractive one. Brakes are inherently "passive", being incapable of moving under their own volition. As a group, they are generally simple, relatively inexpensive, and well adapted to the task of energy dissipation. Ordinary friction brakes, however, have characteristics which limit their usefulness in this application. Among them are problems with breakaway torque, fade, wear, and controllability under rapidly changing load condition. There are attractive alternatives though. The general category into which the eddy current brake fits contains two other types which have characteristics which are well suited to this application. These are the magnetic particle brake and the magnetic hysteresis brake. Both use low power magnetic fields to develop a resistance to motion.

The magnetic particle brake contains a magnetically permeable powder such as iron or mild steel, between its rotor and stator. Electromagnetic coils in the stator magnetize the powder, causing it to bridge between the stator and the rotor, and, in doing so, develop resistance to motion.

The magnetic hysteresis brake uses the well known principal from which it gets its name to develop a resistance to torque. Typically, the stator is circular and formed into an annular shape. The rotor is a hollow cylinder, coaxial with the stator, and supported at only one end, the other rotating within the stator's annulus. The stator contains a series of magnetic pole structures. These are disposed radially, the ones in the outer part of the stator facing inward, and the ones in the inner part facing outward. The poles alternate between north and south, the series running continuously around the circumference of both the outer and inner portions of the stator. The poles are energized by electrical coils in the stator.

When the coils are energized, a magnetic field fills the annulus, its intensity and polarity at any given point depending upon the polarity of the coils nearby, and the degree of excitement of the coils. The rotor is made of an easily magnetized material, and it acquires a pattern of magnetic charges from the field in which it is immersed. As the rotor is turned, its pattern of impressed charges will change to match its changing orientation in the magnetic field, but because of hysteresis, there will always be a difference between the field and the pattern of charges in the rotor. The result is a series of attraction/repulsion reactions between the rotor and the stator, which produce a resistance to movement of the rotor.

Both of these types of brake typically develop torque resistances, which vary only slightly with speed of rotation. Additionally, "breakout torque" (the torque necessary to initiate rotation from a stopped condition) of each is normally less than 5% greater than the running torque. Commercially available examples of each type feature "constant excitement" torques which vary less than plus or minus 5% from 0 to 5000 rpm. This level of performance is achieved with a very simple control system. Typically, all that is required is a low powered, variable voltage, DC power supply. Voltage is variable for the purpose of varying torque resistance in the brake. Normally, the precision of torque resistance adjustment is equal to that of the power supply, with the provision that at a "no excitement" condition, some residual mechanical friction is always present. With this as a minimum, existing commercial examples of both offer a range of adjustment of better than 20:1.

Of the two, the magnetic particle brake is better suited to use in exercise apparatus. For any given level of physical size and expense, it produces an order of magnitude greater torque than the hysteresis brake. Although both have been commercially available for more than 20 years, a patent search has revealed only one attempt at an application in exercise apparatus, European patent application No. 81304852.7, filed 1981 by one A. C. Bently, residing in Rossmore, Calif., concerning the invention of one F. J. Bruder, of Newport Beach, Calif. The apparatus described is a rudimentary device, in which a magnetic particle brake is turned by a simple crank attached to its rotor. The application also describes a relatively unsophisticated control system intended to vary the brake's resistance according to the position of the crank.

In general, the field of electrically based exercise apparatus in the "weight substitute" category seems to be characterized by an emphasis on innovation in the electrical and electronic arts, with much less attention given to the other aspects of the systems. The mechanical arrangements are often quite rudimentary, though this would also be said of much of the rest of the "weight substitute" category. The result of this neglect of the mechanical arts has been a family of devices with desirable safety characteristics, but deficiencies in both performance and ergonomics.

The invention described in this application was created to rectify this situation through sophistication in mechanical design. Beginning with the excellent characteristics of the magnetic particle brake and the magnetic hysteresis brake, a set of specifications was established for the definitive weight substitute exercise apparatus; one in which there would be no significant compromise in performance, safety, or ergonomics.

The exercise apparatus of the present application described below was designed to accomplish the following objectives:

1. Resistance, as apparent to the user, must be completely "passive". The operating means must not move except under the impetus of the user.

2. Resistance, as apparent to the user, must vary only negligibly over the full travel of the operating means.

3. Resistance, as apparent to the user, must vary only negligibly with the speed of operation.

4. The operating means must move in a linear path, preferably vertically.

5.When the operating means is arranged to move vertically, its range of movement must be from below knee level to the "standing, both arms extended" level for normally proportioned people within a height range of 5' 0" to 6' 3". Movement within the range must be continuous.

6. Movement of the operating means should be bidirectional, with resistance for each direction being independently adjustable.

7. The range of adjustment for resistance should be at least 10:1 (e.g. 10 lbs. minimum and 100 lbs. maximum) with continuous adjustment between the limits.

8. Switching of resistances from one direction to the other should be automatic.

9. The apparatus should be such that no mechanical or electrical failure, or plausible combination of failures could cause the operating means to move without impetus from the user.

Meeting them required a variety of mechanical innovations, many of which are unprecedented in this field. A full scale, operating prototype has been constructed. Despite the rather makeshift construction typical in "proof of concept" prototypes, it meets the specifications in every respect.

SUMMARY OF THE INVENTION

The foregoing objects and other objects and advantages which shall become apparent from the detailed description of the preferred embodiment are attained in an exercise apparatus which includes a traveler assembly and means mounting the traveler assembly for movement in a first direction and a second direction. The second direction is opposite to the first direction. The apparatus also includes means for restraining movement of the traveler in the first and second directions. The means for restraining includes cable means which extend from the traveler in the first and second directions. The means for restraining include idler pulleys which engage the cable means and drum means. The drum means is mounted on a single shaft. The cable means extend over the idler pulleys and engage the drum means. Rotation of the drum means in a first angular direction winds the cable means extending in the first direction on to the drum means and winds the cable means extending in the second direction off the drum means. Rotation of the drum means in a second angular direction winds the cable means extending in a second direction on the drum means and unwinds the cable means extending in a first direction from the drum means. The means for restraining includes magnetic braking means.

The first and second directions may be substantially coplanar. The plane may be disposed generally vertically. The apparatus may further include means for counterbalancing the traveler to permit movement in the first and second directions responsive to a force which merely overcomes inertia. In some forms of the invention the traveler may comprise a pair of spaced arms between which a generally horizontally disposed bar is carried.

In some forms of the invention the traveler may engage the cable means with relative motion coupling means. The apparatus may further include first and second switch means and first means carried on the cables cooperating with the first and second switch means for controlling the magnetic brake means. The first switch means may include means to discriminate between the first and second directions. The counterweight is carried, in some forms of the invention, by first and second cables which are laterally spaced with at least a part of the cable means disposed intermediate the first and second cables.

The cable means may include slack adjusting means and a collar. The traveler may include a plate having a bore therein through which the cable means extends. The collar may engage the plate during a portion of the travel of the cable means. The drum means may be a single drum having axially spaced flanges on which the cable means simultaneously winds and unwinds when the traveler is moving. The cable means may include an axial portion including coil springs.

BRIEF DESCRIPTION OF THE DRAWING

The invention will be better understood by reference to the accompanying drawing, in which.

DESCRIPTION OF THE PREFERRED EMBODIMENT

Figure 2:
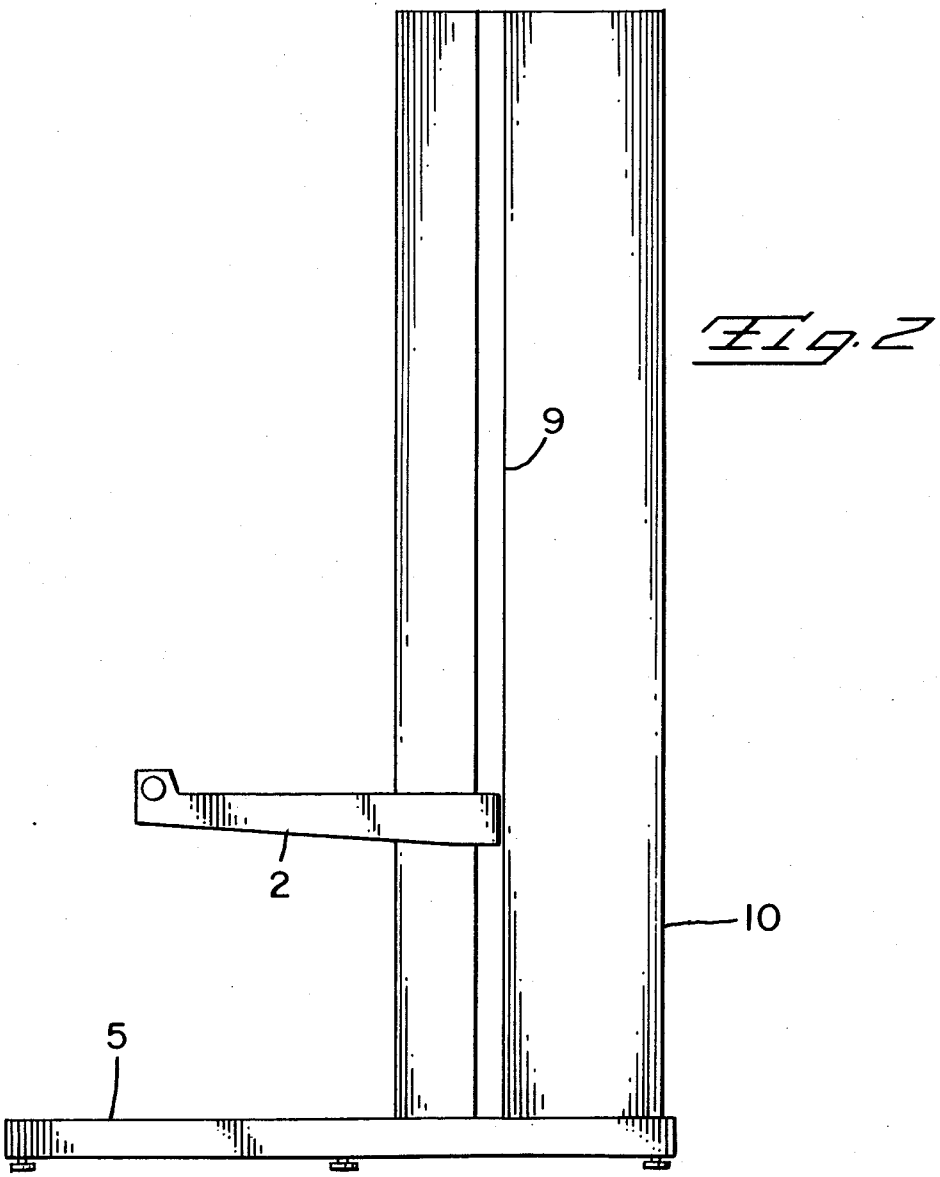
FIG. 2 is a side elevational view of the apparatus shown in FIG. 1.

Operating means 1 is a horizontal bar, which is connected by arms 2 at its ends, to a traveler block 12. This traveler block 12 is connected to a system of guides which allow it to move linearly. The direction of movement is within the discretion of the designer. However, in the preferred embodiment the direction is vertical. The traveler block 12 is connected to two main cables 14 and 18, which run along the same axis but in opposite directions. In the preferred embodiment these are upward and downward. Each cable 14, 18 runs to its respective end of the machine, over two idler pulleys 15, 16 at the top end, and two idler pulleys 19, 20 at the bottom, and then back toward the center of the machine. The cables 14, 18 end at a common cable drum or reel 21 or at a pair of reels 21, 21, mounted on a shaft 25, and arranged so that rotation of the shaft 25 winds one cable 14 or 18 onto the reel 21, while unwinding the other cable 14 or 18 from it. The cable system is therefore "closed", movement of one requiring a complementary movement of the other. In this arrangement, slight inconsistancies in the cable drum 21, or in the way the cables 14, 18 are wound on it, can lead to uneven rates of cable 14, 18 winding and unwinding, with a resulting binding of the system. This problem is dealt with by connecting the cables 14, 18 to the traveler block 12 through springs 26 and 28. These springs 26, 28 extend and retract to compensate for unevenness in the cable 14, 18 winding and unwinding. As these extensions and retractions are reflected in the force necessary to move the operating means 1, springs 26, 28 of low stiffness are used. It has been determined experimentally that the maximum amount of the spring 26, 28 extension and retraction so required is on the order of 0.20 inches, and that spring rates of of 10 lb./in. are satisfactory, providing that enough preload is used and that the springs 26, 28 are properly adjusted. In order to keep the springs 26, 28 from overextending, when the cable 14, 18 to which each is respectively connected is resisting the load applied by the user, positive stops 34, 36 are mounted on the traveler block 12. The positive stops 34, 36 are adjusted to permit a relative motion between the traveler block 12 and the load resisting cable 14, 18 as little as half that of the expected unevenness in the cable 14, 18 winding and unwinding. The reason for this is that as a load is applied to the traveler 12, there will be a relative motion between the traveler 12 and the cables 14, 18 as the relatively weak springs 26, 28 through which the cables 14, 18 are attached to it will extend on the loaded side and retract on the unloaded side. Thus, the operating means 1 can be moved short distances, on the order of 0.2 inches in either direction, without causing movement of the drum 21 or any of the other parts of the apparatus to which the drum 21 is connected. This short band will be referred to herein as a dead band. On the loaded side, the relative motion will cease when all the normal clearance between the positive stop 34, 36 and a fixture 30, 32 on the cable 14, 18 which it engages is used up. The relative motion will transmit this clearance to the other cable 14, 18. For instance, in the case of upward motion, the clearance between the lower stop 36 and the cable fixture 35 will disappear, but the clearance between the upper stop 34 and the cable fixture 30 will increase by the same amount. Since all compensation for winding-unwinding unevenness takes place in the cable 14, 18 not resisting the load, it is the clearance present after the relative motion which must be great enough to make the compensation. As the cables 14, 18 would normally be rigged symmetrically, the nominal (unloaded) clearances could be only ½ that required once a load is applied. This feature keeps the relative motions quite small, the value of which will be explained later in this section.

While the spring 26, 28 extension clearances can be kept smaller than the amount of winding-unwinding unevenness, the spring 26, 28 retraction capabilities must be greater. This is because the relative motion which increases the spring 26, 28 extension clearance on the nonload resisting cable 14, or 18 causes that spring 26, 28 to retract by the same amount. Since at that point no cable 14, 18 winding has yet occurred, full unevenness compensation capability must still be present. The extra amount required is equal to the spring 26, 28 extension clearance. For instance, if a winding-unwinding unevenness compensation capability of plus or minus 0.20 inches is combined with the spring 26, 28 extension clearance of 0.10 inches, the spring 26, 28 retraction clearance must be at least 0.30 inches. However, due to the desirability of preloading the cable 14, 18 system, which requires the spring 26, 28 extension of its own, this clearance requirement is not a serious consideration.

Through this mechanism, linear motion of the operating means 1 is translated into rotational movement of the shaft 25 on which the cable drum 21 is mounted. This motion is then transferred to an electro-magnetic, continuous slip brake 55, in the preferred embodiment, a magnetic particle brake, though a magnetic hysteresis brake would also serve the purpose, which provides the desired resistance to movement. The transfer of motion is done through a mechanical arrangement which increases the speed of rotation while reducing the torque. This is done for two reasons, one economic, and the other functional.

Commercially available brakes of this type must turn at a relatively high speed to reach their maximum power absorption capacity, even at their highest torque setting. In the mechanical arrangement described above, the cable drum 21 would not normally turn nearly as fast. The commercially available magnetic particle brakes 55 generally must turn at speeds on the order of 1000 rpm at their maximum torque setting to reach their full continuous power dissipation capacity, and much faster to reach their intermittent capabilities. The practically sized cable drum 21 in the system being described would seldom, if ever, turn faster than 150 rpm. The torque involved, though, would be enough to require a large, expensive brake of this type if it were connected directly. However, increasing the speed mechanically will reduce the torque commensurately. In this application, using a commercially available magnetic particle brake (the Sperry Model 5 MB 9 OS, manufactured by Sperry Flight Systems of Durham, NC), it was found that a speed increasing ratio in the range of 7.5:1 to 8.5:1 produced a good balance between torque resisting and power absorbing capability, and permitted the use of a small unit.

For purely functional reasons, the use of a small brake is desirable. One of the system design goals was separate, independent control of resistances in the two directions of motion. The brake 55 is therefore required to change its torque resistance setting as fast as the user can reverse the direction of the force applied on the operating means 1. The speed at which brakes of this type can effect a change in setting varies inversely with their size. Large brakes can be slow enough to lag behind the movements of the user to an objectional degree. Small brakes are much better in this respect. The relatively small brake 55 used in the operating prototype can completely energize or de-energize in less than 0.25 second.

Speed change ratios of up to approximately 10:1 can be achieved smoothly and without excessive friction in two stages. In this invention, it is done using pairs of sprockets 42, 44 and 48, 50 connected by chains 43, 49 or toothed belts. The chains 43, 49 are used in the prototype. The arrangement is as follows: The shaft 25 on which the cable drum 21 is mounted also carries the large sprocket 42. This is connected to the matching, but smaller sprocket 44 on a parallel shaft 46, by the chain 43. This shaft 46 also mounts the larger sprocket 48, which is in turn connected by the chain 49 to the matching, smaller sprocket 50, which is directly connected to the brake 55. In the diagrams, the brake 55 is shown mounted on the shaft 52, as it is in the prototype. (In this arrangement, an antirotation link is needed, but is not shown.) In this way, two stages of speed increase and torque reduction is achieved.

Therefore, movement of the operating means 1 is transferred to the traveler 12, which through the "closed loop" cable-drum 21 system, translates it into rotational motion of the shaft 25. This is transferred, through a speed increasing, torque reducing system, to the electro-magnetic, continuous slip brake 55, such as a magnetic particle brake, which is the ultimate source of resistance.

Control of the torque resistance of the brake 55 is effected by a variable output voltage DC power supply. The well designed magnetic particle brake 55 requires relatively little exciting power, and responds with good linearity to the level of current passing through its coils. Since DC is used for this, the current is linearly proportional to the voltage applied, and a properly calibrated voltmeter will give a good indication of the mechanical resistance being developed.

In order to independently control the resistance of each direction of movement of the operating means 1, two power supplies 66, 68 are used, each dedicated to a single direction. Each power supply 66, 68 is continuously energized and specially calibrated voltmeters 72, 74 connected across the outputs give a continuous indication of the force selected for each direction of movement.

Figure 8:
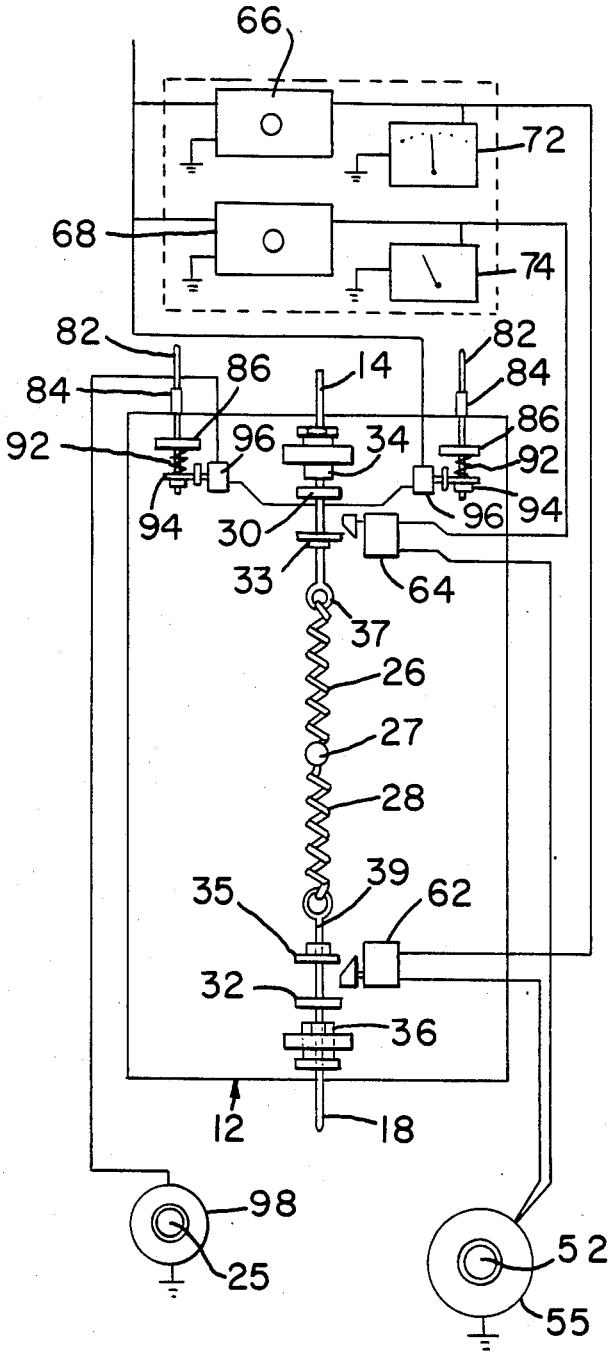
FIG. 8 is an electrical/mechanical schematic of the apparatus's control system.

Referring to FIG. 8, control is a follows: When no force is applied to the operating means 1, the springs 26, 28 align the traveler 12 with respect to the cables 14, 18 so that normally open switches 62 and 64 are not actuated. These switches 62, 64 are connected to the power supplies 66 and 68, which control upward and downward resistances respectively and to the brake 55. When no force is applied, the open switches 62, 64 leave the brake 55 unenergized. When an upward force is applied to the operating means 1, it is transmitted to the traveler 12, which then moves upward with respect to the cables 14, 18, and actuates the switch 62. The output of the "upward" power supply 66 is thus connected to the brake 55, causing it to develop a resistance which is in a known proportion to the applied voltage. The voltmeter 72 indicates this voltage, though it is calibrated in units of force, according to the known relationship between force and voltage applied to the brake 55. The voltmeter 74 serves the same function for resistances to movements in the opposite direction. As both power supplies 66, 68 are always active, though not necessarily connected to the brake 55, the voltmeters 72, 74 always read the amount of resistance to be expected in both directions. When the applied force is released, the springs 26, 28 again align the traveler 12 with the cables 14, 18, opening the switches 62, 64, and de-energizing the brake 55. A similar sequence of events applies to movements in the other direction.

Both safety and operational flexibility require that the assembly consisting of the operating means 1, its connecting arm 2, and the traveler 12 be made effectively "weightless". If this were not done, the substantial weight involved would constitute both a driving force for "backlash" and a minimum resistance to upward motion. Accordingly, a counterweight 80 is provided to balance the weight of this assembly. The arrangement consists of the counterweight 80 itself, which moves vertically in a guideway, and cables 82, 82 and idler pulleys 83, 83, 84, 84 to connect the counterweight 80 to the traveler 12. The two cables 82, 82 are used, running in symmetrical paths, one on either side of the upper main cable 14. The paths are as follows: From attachment points on the traveler 12, the counterweight cables 82, 82 run upward, one on either side of the upper main cable 14 to the idler pulleys 84, 84 at the top of the assembly. The cables 82, 82 then turn to the horizontal, and extend to two more idler pulleys 83, 83 at which they turn downwards, finally reaching their attachment points on the counterweight 80 itself. Exact counterbalancing is not required for safety. Small imbalances can be resisted by the residual friction in the apparatus. The two cables 82, 82 are used for reasons of safety. Should one of the cables 82, 82 break, the other cable 82 would retain full counterbalancing effect, while causing the counterweight 80 to hang askew in its guides, and thus move roughly and noisily, alerting the user to the danger.

Assuming that reasonable care is taken in the sizing of the counterweight 80, the resulting system is "fail safe" as far as the danger of backlash from any single failure is concerned. No single failure, either electrical or mechanical, could cause the operating means 1 to descend. Of all the possible combination of failures, the only one which could cause a backlash would involve the simultaneous failure of both counterweight cables 82, 82. Although this is an extremely unlikely event, the apparatus does provided for this contingency. FIG. 8 shows in schematic form an arrangement by which the failure of the counterweight cable 82 can be sensed electrically, this bringing about the operation of a small brake 98 mounted on the shaft 25 which holds the cable drum 21, locking it in position, and, thus preventing the traveler 12 from descending.

Its operation is as follows: The traveler 12 ends of the counterweight cables 82 are connected to fixtures 86 on the traveler 12 through springs 92, as shown in the drawing. Normally, the tension in the cables 82, 82 keeps the springs 92, 92 compressed, and adjustable fixtures 94, 94 on the cable terminations 84, 84 properly align with the operating means of normally open switches 96. These switches 96, 96, one for each cable 82, 82, are connected in series with each other, a source of power, and the normally engaged, electro-magnetically operated friction brake 98, attached to the shaft 25 on which the cable drum 21 is mounted. In normal operation, power applied to this friction brake 98 activates electromagnets which overcome the force of an internal spring, which otherwise holds the friction brake 98 in engagement, thus allowing the shaft 25 to which it is connected to turn freely. In the event of the failure of one of the counterweight cables 82, the resulting loss of the counterweight cable 82 tension allows the spring 92 to drive a cable termination 84 downward, which allows the switch 96 to open. The circuit is thus broken, allowing the friction brake 98 to engage, thus locking the shaft 25 and the cable drum 21 mounted to it in position. In the preferred embodiment, the friction brake 98 incorporates a one way clutch to allow the operating means 1 to be raised, but not lowered when the friction brake 98 is engaged.

In this arrangement, a backlash can occur only in the event of triple simultaneous failure, involving both counterweight cables 82, 82, and either the top main cable 14 or the back-up brake 98. Since the apparatus is effectively inoperable with any of the cables 14, 18 82, in a failed condition and the back-up brake 98 can be tested simply by trying to move the operating means 1 with the apparatus' power turned off, such a failure is virtually not within the realm of probability.

The following is a description of a single cycle of the machine. For example, it will be assumed that the user desires to begin an exercise at shoulder level, raise the operating means 1 to an "arms fully extended position", and then bring it back to shoulder level.

The user steps onto a platform 5 and turns on power to the various components using a switch on the control panel 3. Then, using the resistance selection controls on the same control panel 3, both upward and downward resistances are set to their minimum, which is the level of residual system friction, for the purpose of moving the operating means 1 to the starting position for the exercise, which in this case is the user's shoulder level. The operating means 1 will remain in this position until moved due to the counterbalancing provided in the system. With the operating means 1 located to the user's satisfaction, the desired upward and downward resistances are selected. The values selected are read from the voltmeters 72, 74 on the control panel 3, which actually monitor the voltage output of the two power supplies 66, 68, though they are calibrated in units of force.

At this point, the direction sensing switches 62, 64 are both open, and no power is provided to the brake 55. The backup braking means 98 is powered at this point, releasing it from engagement, and allowing the traveler 12 to be moved in both directions. Exercise can now begin.

When the operating means 1 is pushed upward, the traveler assembly 12, to which it is connected, moves slightly in relation to the main cable assemblies 14, 18, closing the switch 62 and, thus, powering the brake 55. The user senses the onset of the selected resistance as occurring almost instantaneously. The operating means 1 is then moved upward against the resistance. At any point, the operating means 1 may be released, in which case it will immediately stop. When the end of the movement is reached, the user reverses the direction of effort, with or without an intervening pause. The result is a relative motion between the traveler 12 and the main cable assemblies 14, 18, which causes the switch 62 to open and the switch 64 to close, disengaging the upward power supply 66 and engaging the downward power supply 68. if minimum resistance is desired for the downward movement, the resistance setting is appropriately at minimum, leaving only residual system resistance to be overcome. When the end of the downward movement is reached, the operating means 1 may be released, or started upward again to begin a new cycle. At any time, the operating means 1 may be released, and it will not move farther. Also, resistance can be changed at any time, even while the user is still moving the operating means 1, simply by operating the appropriate control on the panel 3.

This invention can be characterized by conceptual sophistication placed in the service of operational practicality. While some of its features, such as the cable 14, 18 and the drum 21 arrangement, the class of the brake 55 used, and the counterweight 80 system, are central to the proper functioning of the apparatus, there are others which are included for reasons of operational refinement and economy of construction. These are as follows:

Braking means: Within the class of electro-magnetic, continuous slip brakes, the preferred braking means is a magnetic particle brake, though a magnetic hysteresis brake could also be made to serve the purpose. The magnetic particle brake is preferred because its torque and power absorption characteristics are an order of magnitude greater than those of a magnetic hysteresis brake of comparable physical size and expense. Both of these types have been available commercially in the United States for at least 20 years. The magnetic particle brake used in the prototype is manufactured by Sperry Flight Systems, a division of the Sperry Corporation, in Durham, North Carolina. This firm manufactures a complete line of brakes and clutches using this principle. There is at least one other firm in the United States offering a comparable line of products. Almost all of these are used in industrial applications.

Cable drum arrangement: The cable drum 21 system used may be either a single drum 21 with cable anchoring attachments at both ends, or two drums 21, 21, each anchoring one cable 14, 18. In either case, grooves in the drum 21 faces guide the cables 14, 18 in winding. A single drum 21 is more compact, and is likely to demonstrate the most uniformity in simultaneous winding and unwinding. The use of two drums 21, 21 can be advantageous in that each drum 21 would experience torques in a single direction only, thus avoiding the reversing loads experienced by a single drum 21 and simplifying the task of mounting the drum 21 to its shaft 25. A single drum 21 is shown in the figures accompanying this text, though there is no preference between the two approaches.

In the figures, the cable drum 21 is shown located roughly in the vertical center of a columnar structure 8. This is done to minimize deviations from the ideal winding angle as the cables 14, 18 wind and unwind. Maintaining the proper angle is important if mistracking is to be avoided.

Traveler assembly 12: The traveler assembly 12 is shown in a rough schematic in FIG. 8 and in a preferred form in FIGS. 5, 6, and 7. Aside from the greater depiction of detail, the principal differences between the figures have to do with configurations intended to minimize the physical size of the traveler assembly 12, particularly its length along its axis of travel. This is necessary in order to maximize its useful travel. This is accomplished through two techniques. The first is a superposition of the main cables 14, 18 where they attach to the traveler assembly 12. The second involves means of avoiding interference between the traveler assembly 12 and the idler pulleys 15, 16, 19 and 20.

FIG. 8, an electrical and mechanical schematic, shows the two main cables 14, 18 connected through the springs 26, 28 to the traveler assembly 12 at a common point 27. This arrangement results in a need for a traveler assembly 12 which is undesirably long. The condition is improved by placing the two main cable assemblies 14, 18 in separate, parallel planes, instead of in a single plane. Enough separation between the two cable assemblies 14, 18 permits the attachment points to be moved to positions near the ends of the traveler assembly 12, the attachment of the upper main cable 14 below that of the lower main cable 18 being of no functional importance, and it permits a substantial savings in the length of the traveler assembly 12.

Figure 5:
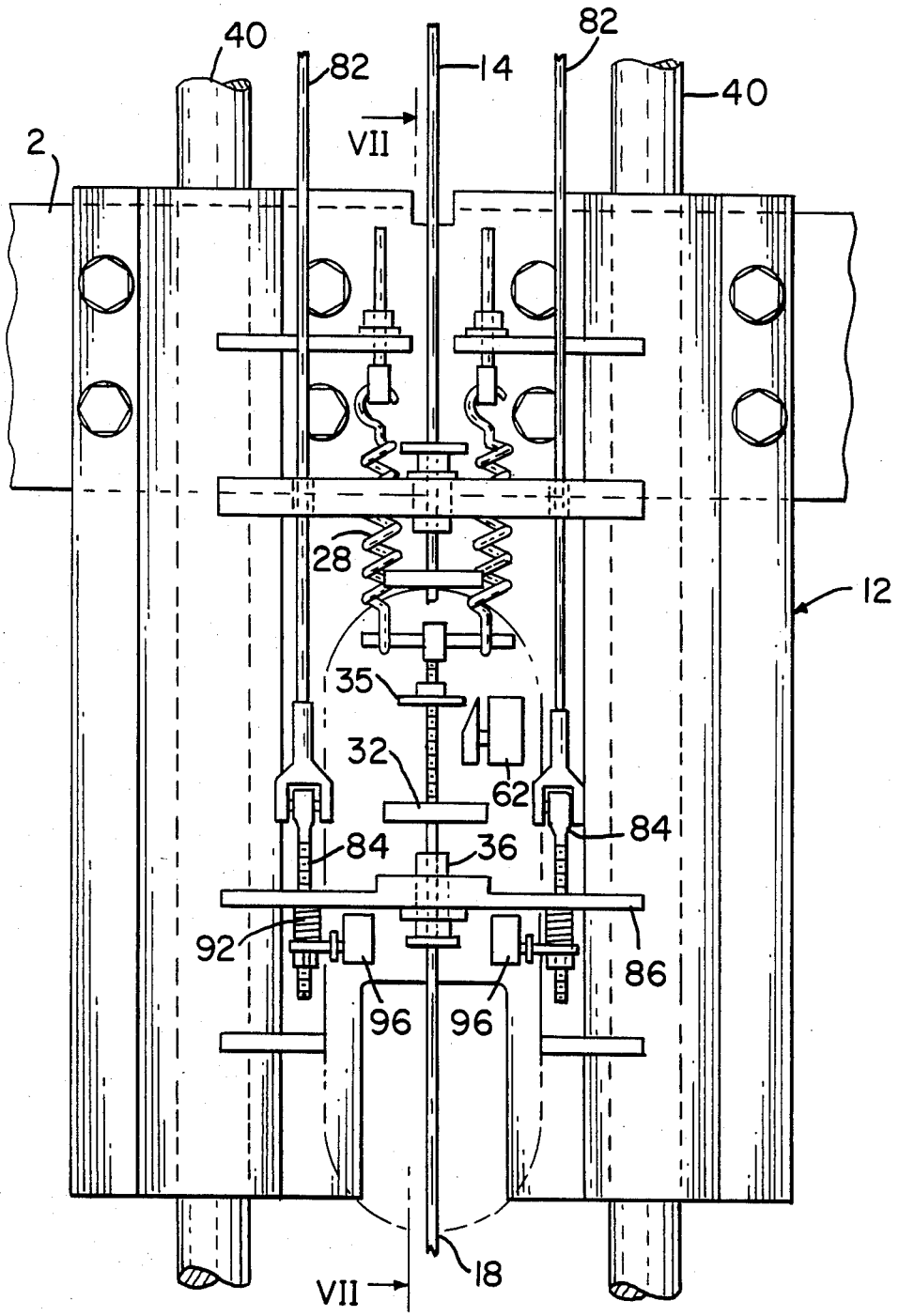
FIG. 5 is a partially schematic view, showing the details of the traveler assembly and cable system not visible on other views.
Figure 7:
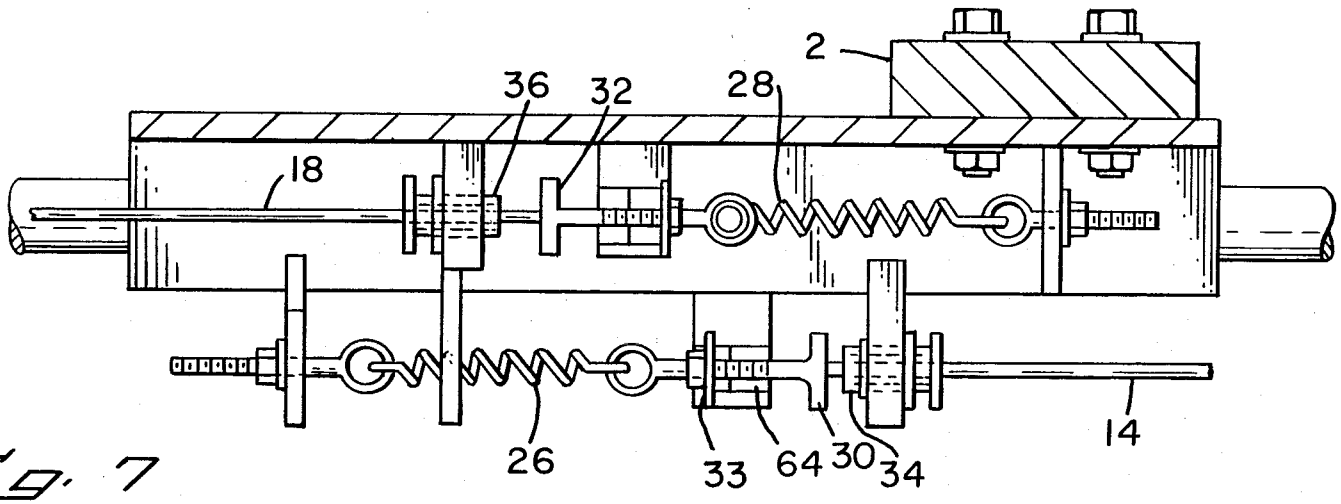
FIG. 7 is a sectional view, taken along the line VII—VII of FIG. 5.
Figure 6:
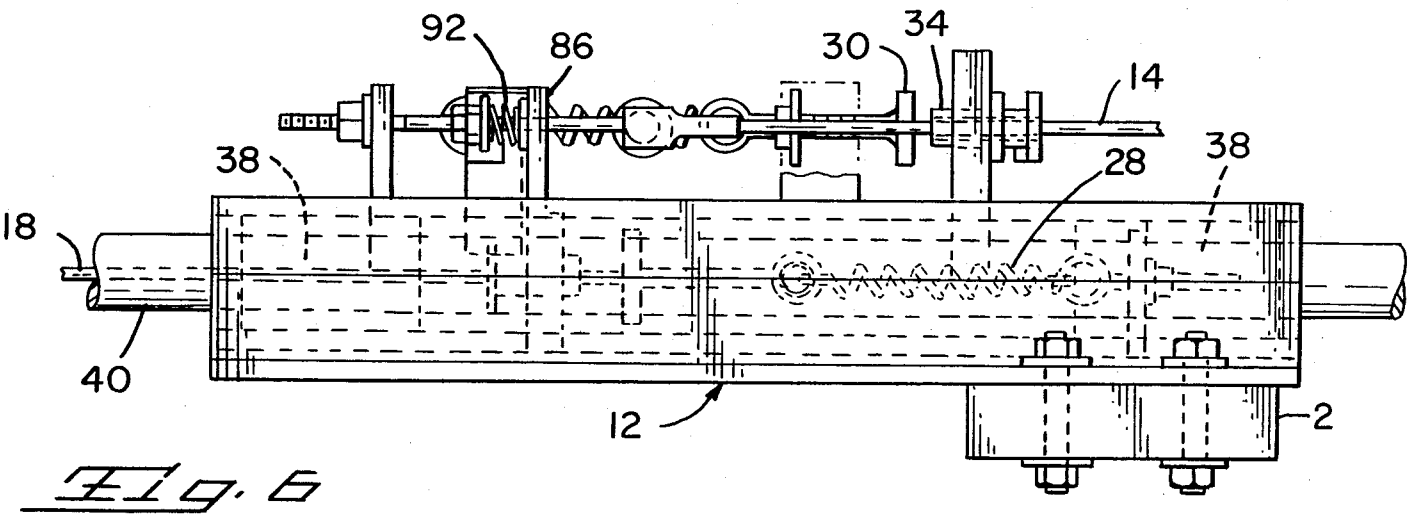
FIG. 6 is a side view of FIG. 5.

More space is saved by arranging the traveler 12 and the upper and lower pulleys 15 and 19 in such a way that the traveler 12 can extend past the pulleys 15 and 19. This is done in two basic ways: One is to offset the cable 14, 18 attachments from the plane of movement of the traveler 12 enough to permit the body of the traveler 12 to pass longitudinally behind the pulleys 15 and 19. The other way is to sculpture the traveler 12 to avoid contact with the pulleys 15 and 19, as the traveler 12 moves to the ends of the column structure 8. FIGS. 5, 6, and 7 show both techniques used, with an offset at the top, and sculpturing at the bottom. When it is desirable to also minimize the longitudinal dimension (depth) of the traveler 12, the sculpturing technique becomes most advantageous.

FIGS. 5, 6, and 7 show the cables 14, 18 to be attached to the traveler 12 in ways which allow their tension to be easily adjusted. These figures also show the counterweight cables' 82, 82 attachment points at the lower end of the traveler assembly 12 instead of the upper, as shown in the schematic drawing of FIG. 8. This is done because of the concentration of details at the upper end. The actual attachment points are not functionally important.

Speed increasing/torque reduction system: The two stage chain or tooth belt 43, 49 speed increasing-torque reduction system has the advantage of low cost and smooth operation. Gear type devices could be used, but would be relatively expensive. A single stage chain or belt system would be impractical in the speed change region under consideration (on the order of 8:1) because of the need for frequent, rapid reversal. In a single stage system in this range, the smaller sprocket would be so small in relation to the overall length of the chain or belt that the inevitable slack in the system, which occurs as a function of the length of the chain or belt in it, would be great enough to lead to problems with tooth engagement at the smaller sprocket during reversal. In a two stage system, ordinary amounts of slack are not a problem. For instance, an overall ratio of 8:1 can be achieved with two stages of approximately 2.8:1, a range in which slack is much less of a problem. The amount of slack present is controlled by the common technique of mounting the bearings of the shafts on sliding bases or ways.

Control system: As already explained, the preferred control system senses the direction of the force applied on the operating means 1 by sensing the direction of the initial relative motion between the traveler assembly 12 and the main cables 14, 18. For this purpose, adjustable flanges 33, 35 are provided on the cable termination fixtures 37, 39. These make contact with the switches 62, 64 connected to the separate power supplies 66 and 68 provided for upward and downward resistance, and the brake 55. When no force is applied, both the switches 62, 64 are open, and the brake 55 receives no power. Separate power supplies 66 and 68 are preferred to a single, switchable power supply, the advantages being simplicity and the fact that their output can be read from the voltmeters 72, 74 connected across their output terminals even when they are not being called upon to deliver power.

Backup anti-backlash system: As previously explained, the counterweight 80 is arranged so that a backlash can occur only in the extremely unlikely event of a simultaneous failure of both counterweight cables 82, 82. Further protection can be provided in the form of the automatically acting brake 98, connected to the shaft 25 which holds the cable drum 21.

As shown in FIGS. 5 and 6, the counterweight cable 82, 82 attachment points on the traveler 12 are spring loaded, and arranged so that loss of tension in either cable 82, 82 will result in a release of a holding force keeping a normally open switch 96 closed. These switches 96, 96, one for each counterweight cable 82, are connected in series to the source of power of 66, 68 and to the electro-magnetically operated one way clutch-brake 98. This unit is attached to the shaft 25 holding the cable drum 21 and is arranged so that engagement of the brake 98 will allow the drum 21 to turn in the direction corresponding to upward movement of the traveler 12, but not in the direction necessary for downward movement. Such clutch-brakes 98 are simply a combination of a brake and a one way clutch and are available commercially in both "energize to engage" and "energize to disengage" forms. The latter is preferred because of its "fail safe" nature, and the operating sequence has been so designed. As long as the counterweight cables 82, 82 are under tension, switches 96, 96 will be closed, and the clutch-brake 98 will be disengaged, permitting free movement of the system. Loss of power to the clutch-brake 98 from any cause will result in its engagement. With this arrangement, even the extremely unlikely event of a simultaneous failure of both counterweight cables 82, 82 would not result in a backlash of the operating means 1.

Figure 1:
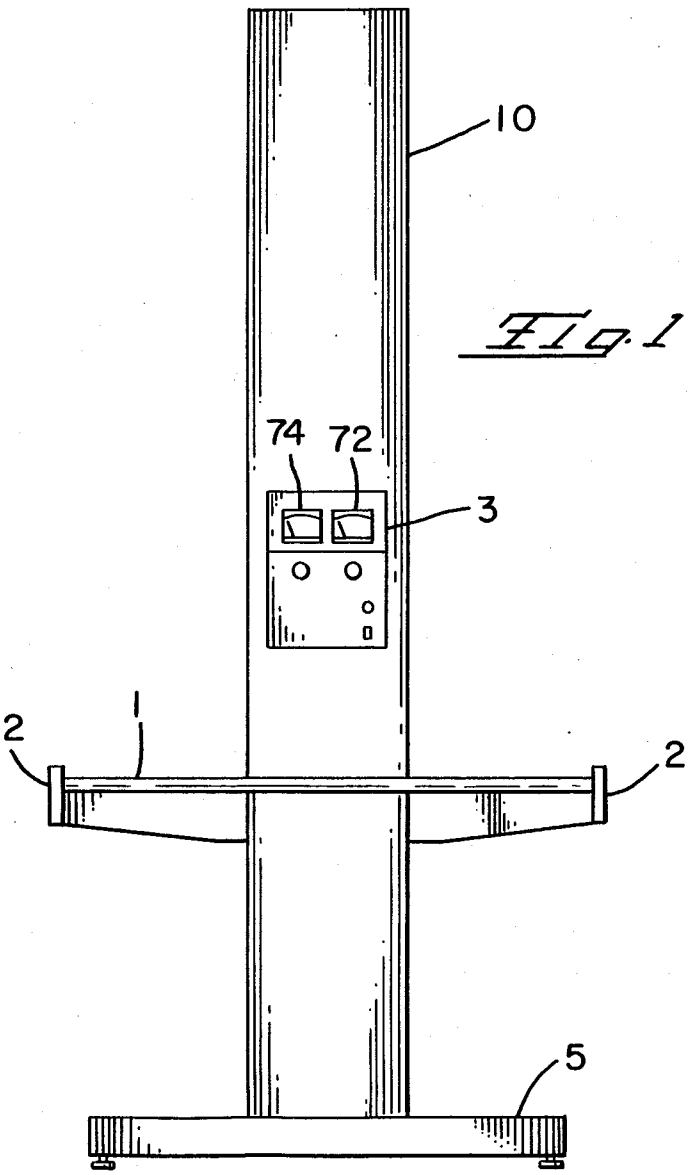
FIG. 1 is a front elevational view of one form of the apparatus in accordance with the invention.

Traveler guide system: The arrangement of the operating means 1 shown in FIGS. 1 and 2 is ergonomically excellent, but forces applied to it produce large bending moments in the traveler assembly 12. Moreover, as users are expected to utilize the operating means 1 for stability during exercise, secondary forces in any direction must be provided for. The means of doing this must involve relatively little friction in order to avoid compromising the traveler 12 self-alignment feature, which is part of the preferred control system. These requirements have been met using a system of linear ball bearings 38, 38, 38, 38 running on cylindrical ways 40, 40. These ball bearings 38, 38, 38, 38 are commercially available items, and generically have excellent load carrying and friction characteristics. The principal impediment to their use is their inherently low tolerance of variance in the spacing of the ways 40 on which they run. This problem has been dealt with by using semi-rigid mounting of the ways 40. In this arrangement, the spacings of the linear ball bearing 38 in the traveler assembly 12 controls the way 40 spacings. The linear ball bearings 38 are used in pairs, the pair on each way 40 being as widely separated as the height of the traveler 12 will allow, to minimize loadings as torques are resolved into force couples.

Figure 3:
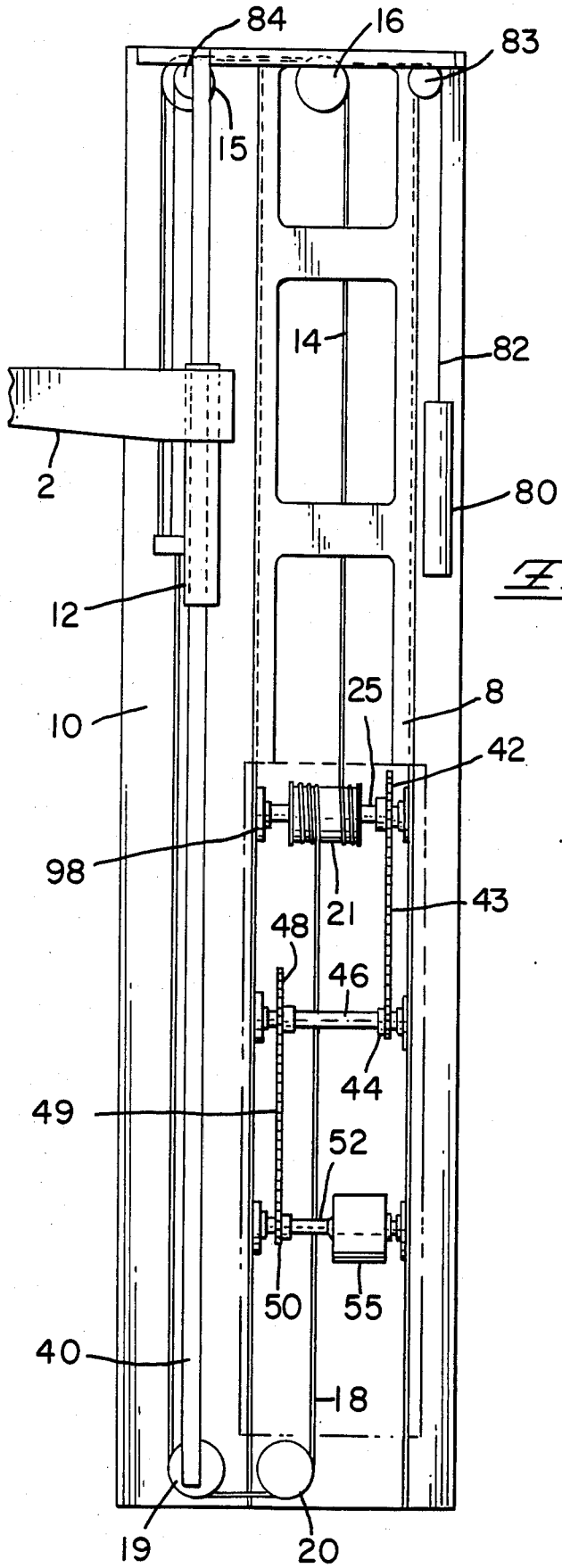
FIG. 3 is a side elevational view of a portion of the apparatus with enclosure panels removed, exposing functional components.
Figure 4:
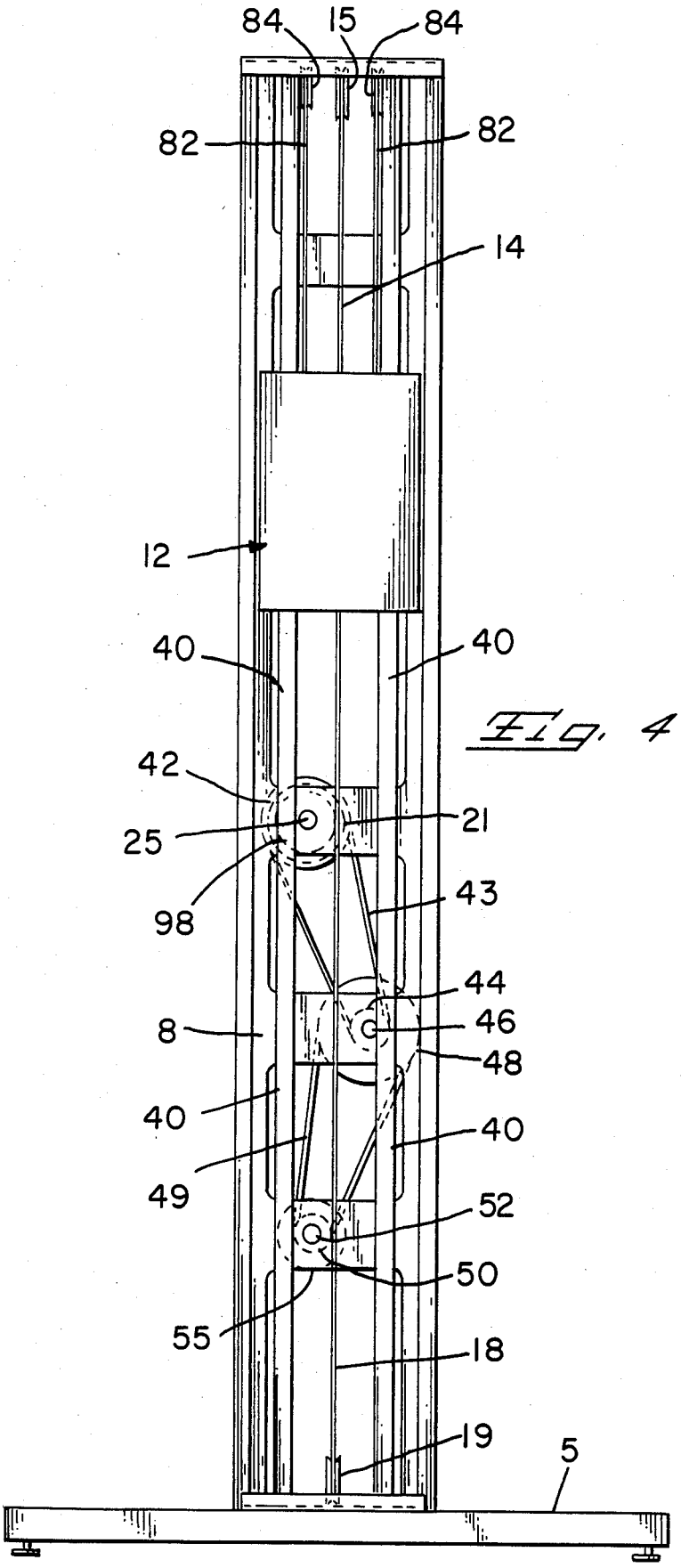
FIG. 4 is a front elevational view similar to FIG. 3.

General configuration: The apparatus can be configured for operation in any direction, but vertical movement is preferred. A layout is shown in FIGS. 1 and 2. The operating means 1 is a horizontal bar, long enough to provide a comfortable grip for a large person and is attached to the traveler block 12 inside a main columnar enclosure 10 with the two arms 2. The arms 2, 2 enter through slots 9, 9 in the sides of the columnar enclosure 10 in order to allow mounting of the control panel 3 on the front. The columnar enclosure 10 is a non-structural covering of the column structure 8 in FIGS. 3 and 4 and is used for cleanliness and noise reduction purposes. The column 8 stands on and is attached to the platform or base 5, on which the user stands while operating the apparatus. The base 5 serves to establish physical continuity with the column 8 and provides a force reaction path for balancing of the applied loads. If this were not done, it would be necessary to attach the column 8 securely to a separate structure such as a floor or the wall to assure stability under load.

Having thus described my invention, I claim:

1. Exercise apparatus, comprising:

a traveler assembly having operating means for engagement by a user;

means mounting said traveler assembly for bidirectional movement in opposite directions;

at least one tensioning means connected to said traveler assembly;

at least two cable means connected to said tensioning means and thereafter to a drum means, such that movement of the traveler assembly will cause one of said cable means to wind onto said drum means and the remaining cable means to unwind from said drum means wherein said tensioning means provides said cable means with a self adjusting amount of tension and slack for eliminating binding of said cable means as a result of uneven winding and unwinding of said cable means on said drum; and an adjustable magnetic particle braking means connected to said drum means for providing continuously uniform resistance to movement of said drum means and thereby said traveler assembly through the full range of movement of said traveler assembly.

2. A device according to claim 1 wherein a direction sensing means is connected to said resistive braking means thereby allowing said resistive braking means to apply braking force to the drum assembly and thereby said cable means in accordance with the direction of the force applied to said traveler assembly, said direction sensing means comprising at least one switch means and a first means carried on one of said cable means cooperating with said switch means.

3. A device according to claim 1 wherein the weight of said traveler assembly is counterbalanced by a counterweight means, said counterweight means comprising at least two cable means connected to said traveler assembly and a weight such that the weight of the traveler assembly is counterbalanced by said cable means and said weight, said counterweight means further comprising a cable breakage sensing means for detecting the breakage of one or more of said cable means.

4. A device according to claim 3 wherein an emergency braking means is connected to said drum means and is adapted to receive said output signal such that upon receipt of said output signal, said emergency braking means prohibits the rotation of the drum means in a direction corresponding to downward movement of the traveler assembly.

5. A device according to claim 1 further comprising:

a counterweight means having at least two cable means connected to said traveler assembly and a weight such that the weight of the traveler assembly is counterbalanced by said cable means and said weight, said counterweight means further comprising a cable breakage sensing means for detecting the breakage of one or more of said cable means.

6. A device according to claim 5 wherein an alarm means is connected to said breakage sensing means for warning said user of a broken cable.

7. A device according to claim 5 wherein a braking means is connected to said breakage sensing means for inhibiting the movement of said traveler assembly upon the breaking of a cable.

8. Exercise apparatus, comprising:

a traveler assembly having operating means for engagement by a user;

means mounting said traveler assembly for bidirectional movement in opposite directions;

at least one tensioning means connected to said traveler assembly;

at least two cable means connected to said tensioning means and thereafter to a drum means, such that movement of the traveler assembly will cause one of said cable means to wind onto said drum means and the remaining cable means to unwind from said drum means wherein said tensioning means provides said cable means with a self adjusting amount of tension and slack for eliminating binding of said cable means as a result of uneven winding and unwinding of said cable means on said drum; and an adjustable magnetic hysteresis braking means connected to said drum means for providing continuously uniform resistance to movement of said drum means and thereby said traveler assembly through the full range of movement of said traveler assembly.

* * * * *